United States Patent [19]

Bianchi

[11] 4,067,219

[45] Jan. 10, 1978

[54] HEAT EXCHANGER FIN ROLL

[75] Inventor: Sabatino A. Bianchi, Bloomfield Hills, Mich.

[73] Assignee: Bernard J. Wallis, Dearborn, Mich.

[21] Appl. No.: 780,428

[22] Filed: Mar. 23, 1977

[51] Int. Cl.[2] ..... B21D 53/04

[52] U.S. Cl. ..... 72/186; 113/1 C

[58] Field of Search ..... 72/186, 187; 113/1 C

[56] References Cited

U.S. PATENT DOCUMENTS

| | | | |
|---|---|---|---|
| 3,367,161 | 2/1968 | Avakian | 72/186 |
| 3,433,044 | 3/1969 | Rhodes et al. | 72/186 |

*Primary Examiner*—Lowell A. Larson

*Attorney, Agent, or Firm*—Barnes, Kisselle, Raisch & Choate

[57] ABSTRACT

Rolls for forming convoluted heat exchanger strips having louvers in the successive convolutions. The rolls comprise a series of axially stacked upper and lower discs having intermeshing gear-like teeth around their periphery for forming convolutions in a metal strip and for cutting and forming the louvers therein. The cutting teeth have their opposite side faces beveled, the beveled face on the leading side of the tooth extending radially outwardly from the area of the crotch between teeth through the tip of the tooth. On the trailing side of each tooth the beveled face extends radially outwardly from more closely adjacent the vertex of the crotch to a point short of the tooth tip.

10 Claims, 14 Drawing Figures

HEAT EXCHANGER FIN ROLL

This invention relates to the manufacture of heat exchangers of the type comprising a metal strip formed with zig-zag convolutions having fins or louvers therein, and, more particularly, to a device for cutting and forming such strips.

Heat exchanger strips of the type referred to are normally cut and formed by directing a thin metal strip through a pair of rolls having intermeshing gear-like teeth provided with cutting edges which form successive groups of parallel slits in the strip, bend the metal between the strips to form the louvers, and simultaneously form spaced successive bends in the strip into alternately disposed convolutions. A typical set of such rolls is shown in FIG. 5 herein. Such rolls typically embody a plurality of axially stacked discs, each formed with a plurality of cutting teeth spaced uniformly around its periphery. The two rolls are arranged one above the other with the teeth in meshing relation. When the rolls are rotated the tips of the successive teeth on one roll intermesh with the crotches between the successive teeth on the other roll. Between the tips and the crotches the teeth are formed with arcuate side faces which are beveled transversely of the plane of the disc. The beveled faces provide cutting edges on opposite sides of the discs.

As shown in FIG. 5 herein, in such prior art rolls the teeth are symmetrically shaped relative to radial lines passing through the apices of the teeth and the vertices of the crotches. Experience has shown that such symmetrically shaped teeth give rise to several undesirable structural characteristics on the finished heat exchanger strip. For example, in order for the tips of the teeth on one roll to clear or roll out of the crotches between the teeth on the other roll, the length of the louvers or fins cannot exceed a predetermined dimension relative to the length of the convolution itself. However, it is desirable to provide fins or louvers of maximum length in order to provide maximum heat transfer.

In addition, careful inspection of heat exchanger strips formed in accordance with prior art rolls reveals that the louvers are not symmetrically disposed relative to the convolutions and the convolutions themselves are not symmetrical. The louver is located closer to the crest of the return bend at one end of each convolution than to the crest of the return bend at the other end of the convolution. Likewise, the return bends themselves are not of symmetrical shape. These characteristics reduce the efficiency of the heat exchanger.

The present invention has for its object the provision of rolls for such heat exchanger strips in which the length of the louver can be a maximum dimension, limited only by the strength considerations of the strip rather than by design limitations in the shape of the teeth and the clearances required. The forming rolls are also designed so that the louvers will be symmetrically disposed with respect to the successive convolutions and the return bends will be of symmetrical shape.

More specifically, in the present invention the leading side of each tooth is beveled from within the crotch area radially outwardly through the tip of the tooth. In addition, the cutting edge on the trailing side of each tooth extends radially inwardly into the crotch area to a greater extent than the leading side of each tooth and radially outwardly to a point adjacent, but spaced from, the tooth tip. The combination of these two features results in the cutting of a longer louver than is possible with rolls of conventional design, louvers that are symmetrically located with respect to the crests of the convolutions, and return bends of smoothly rounded symmetrical shape.

Other objects, features and advantages of the present invention will become apparent from the following description and accompanying drawings, in which.

FIGS. 10 thru 14 are fragmentary views of a pair of form rolls according to the present invention showing the progressive formation of the louvers and convolutions in a metal strip.

Figure 1:
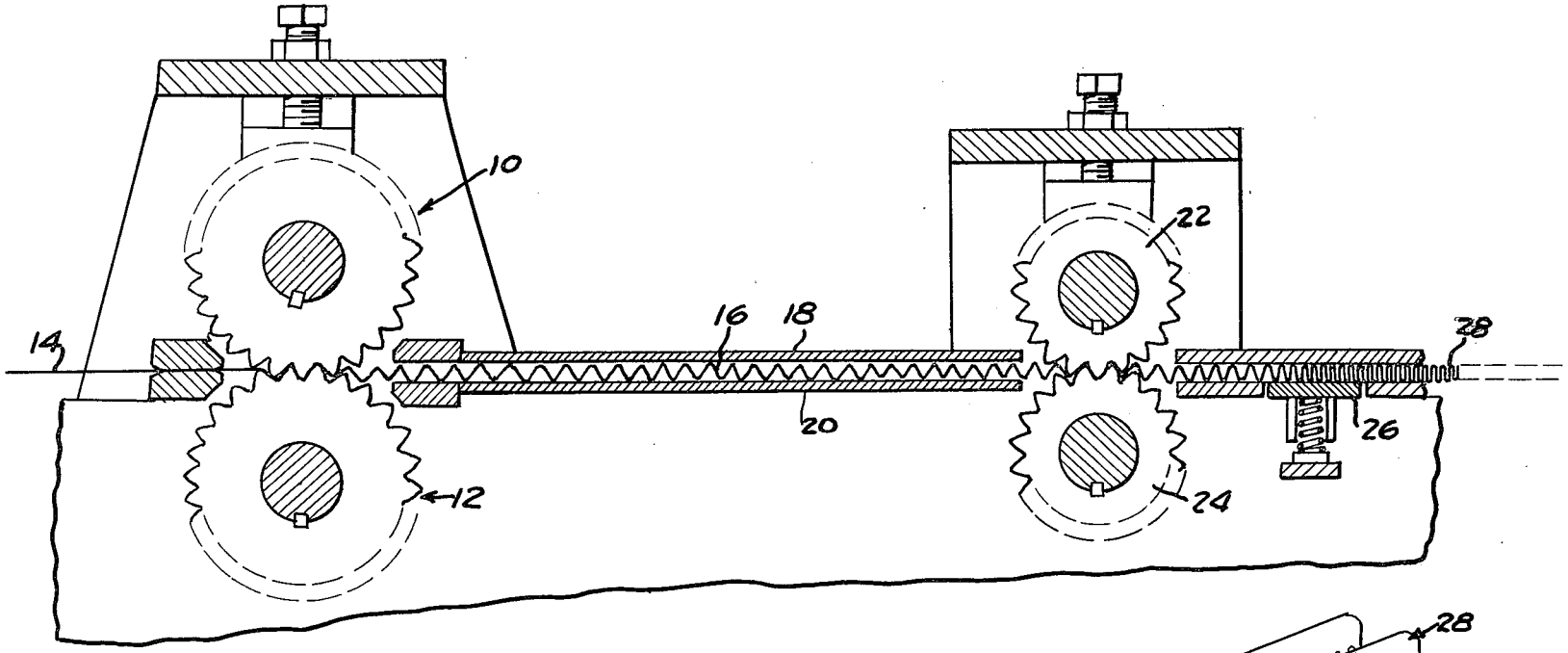
FIG. 1 is a longitudinal sectional view, somewhat diagrammatic, of an apparatus embodying the present invention for forming louvered heat exchanger strips.

Referring first to FIG. 1, there is illustrated a portion of a generally conventional fin roll machine which includes a pair of form rolls 10 and 12 mounted on the frame of the machine in intermeshing relation as illustrated. Sheet metal ribbon stock 14 is fed from a pair of feed rollers (not illustrated) between form rolls 10 and 12 such as to form corrugations therein, the strip emerging from the form rolls being illustrated at 16. As the corrugated strip 16 emerges from form rolls 10, 12 it is guided by rails 18, 20 to a pair of gathering rolls 22, 24 which advances the corrugated strip towards a spring pressure plate 26. Pressure plate 26 cooperates with rail 18 to frictionally retard the advancing movement of the corrugated strip so that it is gathered or compressed lengthwise by further bending at the crests of the convolutions into its finished form as shown at 28. Insofar as the apparatus illustrated in FIG. 1 is concerned the present invention has to do only with the design and configuration of the form rolls 10, 12, the remainder of the apparatus is conventional and may comprise devices other than those specifically illustrated.

Figure 2:
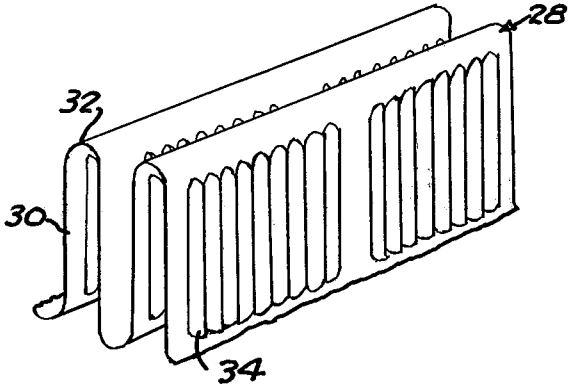
FIG. 2 is a perspective view of a section of the heat exchanger strip.

The finished strip 28 shown in FIG. 2 comprises successive convolutions 30 connected by return bends 32 at the opposite ends thereof. Each convolution is formed with a plurality of fins or louvers 32 which are cut and twisted so that they project from opposite sides of each convolution.

Figure 4:
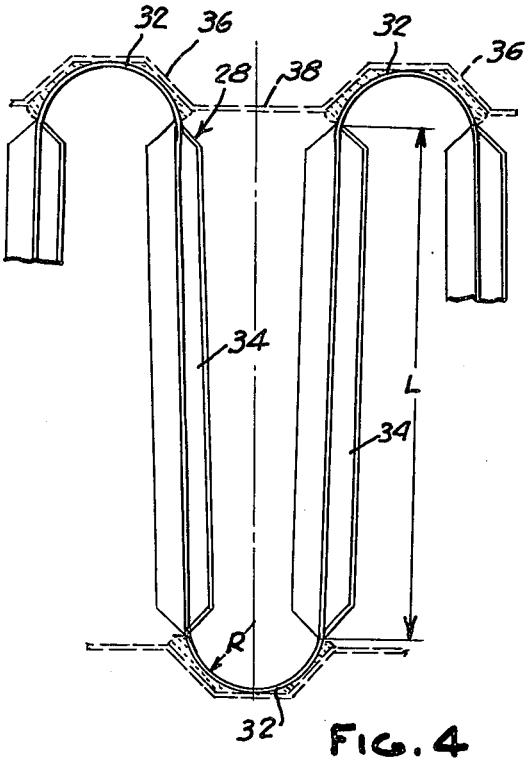
FIG. 4 is a view similar to FIG. 3 and showing a convoluted heat exchanger strip made with form rolls according to the present invention.

Referring now to FIG. 4, the formed strip 28 is illustrated as embodied in a heat exchanger. The return bends 32 are soldered within spaced troughs 36 in partition strips 38. In a heat exchanger of ideal and efficient design it is desirable to have the return bends 32 of generally uniform semi-circular shape with the louvers 34 disposed symmetrically on opposite sides thereof and terminating at their opposite ends directly adjacent the ends of the semi-circular return bends 32. In other words, it is most desirable to have the dimension R closely approximating a radius and the dimension L of all of the louvers at a maximum and terminating at the ends of the return bends 32. The form rolls 10, 12 of the present invention comprise a series of axially stacked discs designed so that the fully formed strip assumes the shape illustrated in FIG. 4 when soldered to partition strips.

Figure 5:
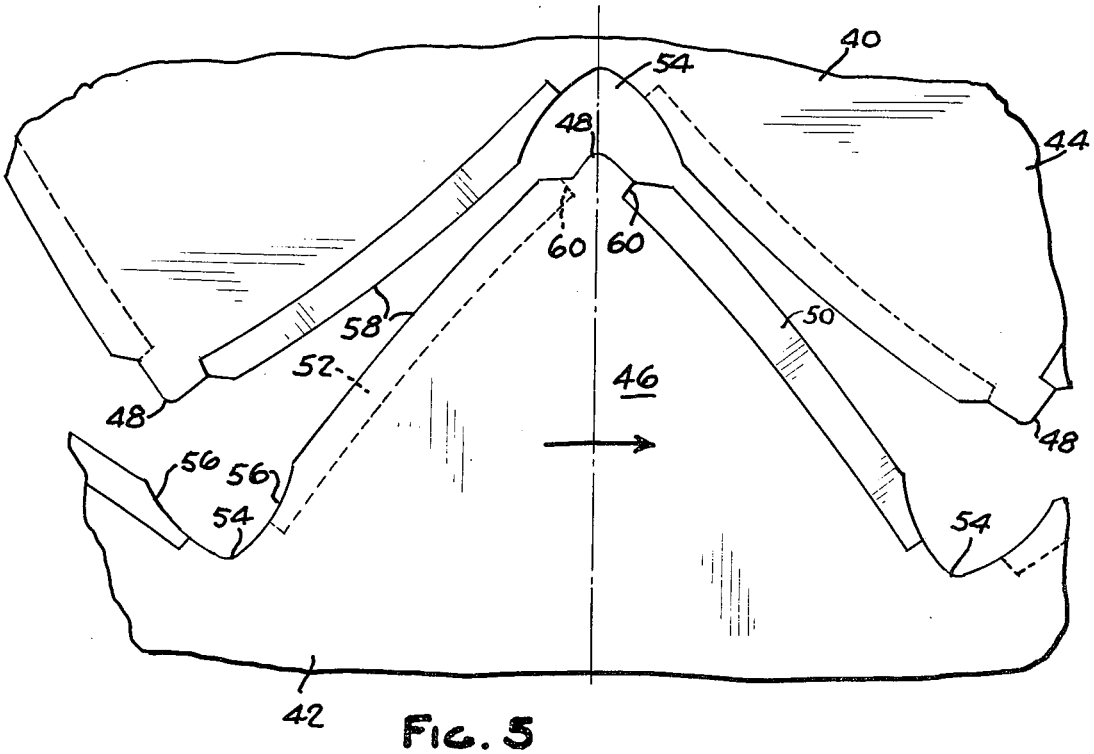
FIG. 5 is a fragmentary view on an enlarged scale of a pair of form rolls according to the prior art.

Form rolls as heretofore constructed comprise a series of axially stacked upper and lower discs of the type illustrated generally in FIG. 5. The upper disc 40 and the lower disc 42 are formed with similarly-shaped teeth 44, 46, respectively. Each tooth is formed with a rounded crest 48 and beveled side faces 50, 52. The space between successive teeth comprises a crotch 54 defined by symmetrically arranged clearance arcs 56 which accommodate the tooth tips 48 when the rolls are rotated. The outer edges of beveled faces 50, 52 define cutting edges 58. It will be observed that the beveled faces 50, 52 extend into the crotch area but terminate, as at 60, radially inwardly of the tooth tips 48. Thus, the tip 48 of each tooth has the same thickness throughout as the disc itself. Accordingly, the clearance arcs 56 are sufficiently great in radius and length to permit the tips 48 to roll into and out of the crotch areas when a metal strip is positioned therebetween.

Figure 3:
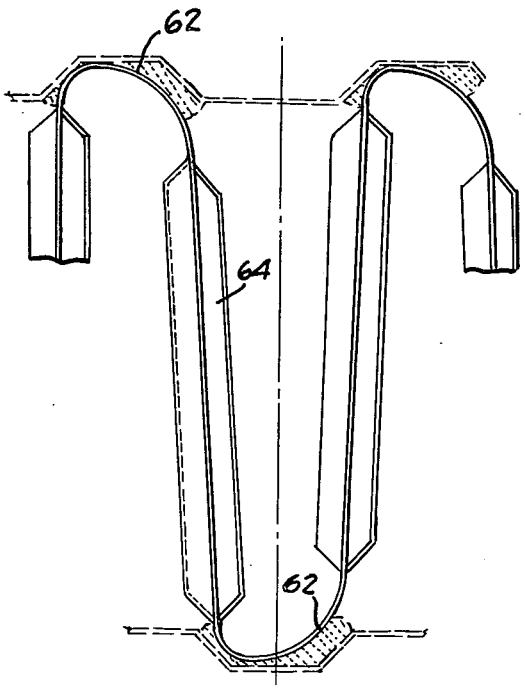
FIG. 3 is a fragmentary sectional view illustrating a heat exchanger fabricated from a convoluted strip made with form rolls as heretofore designed.

Referring now to FIG. 3, experience with fin forming rolls of the type shown in FIG. 5 reveals that the return bends 62 of the convoluted strip are actually of parabolic shape rather than of generally semi-circular shape and that the louvers 64 are located much closer to the return bend 62 at one end of a convolution than to the other end of the convolution. Because of the generally parabolic shape of the return bend and the unsymmetrical location of the louvers, the heat transfer efficiency of the heat exchanger is impaired.

Figure 6:
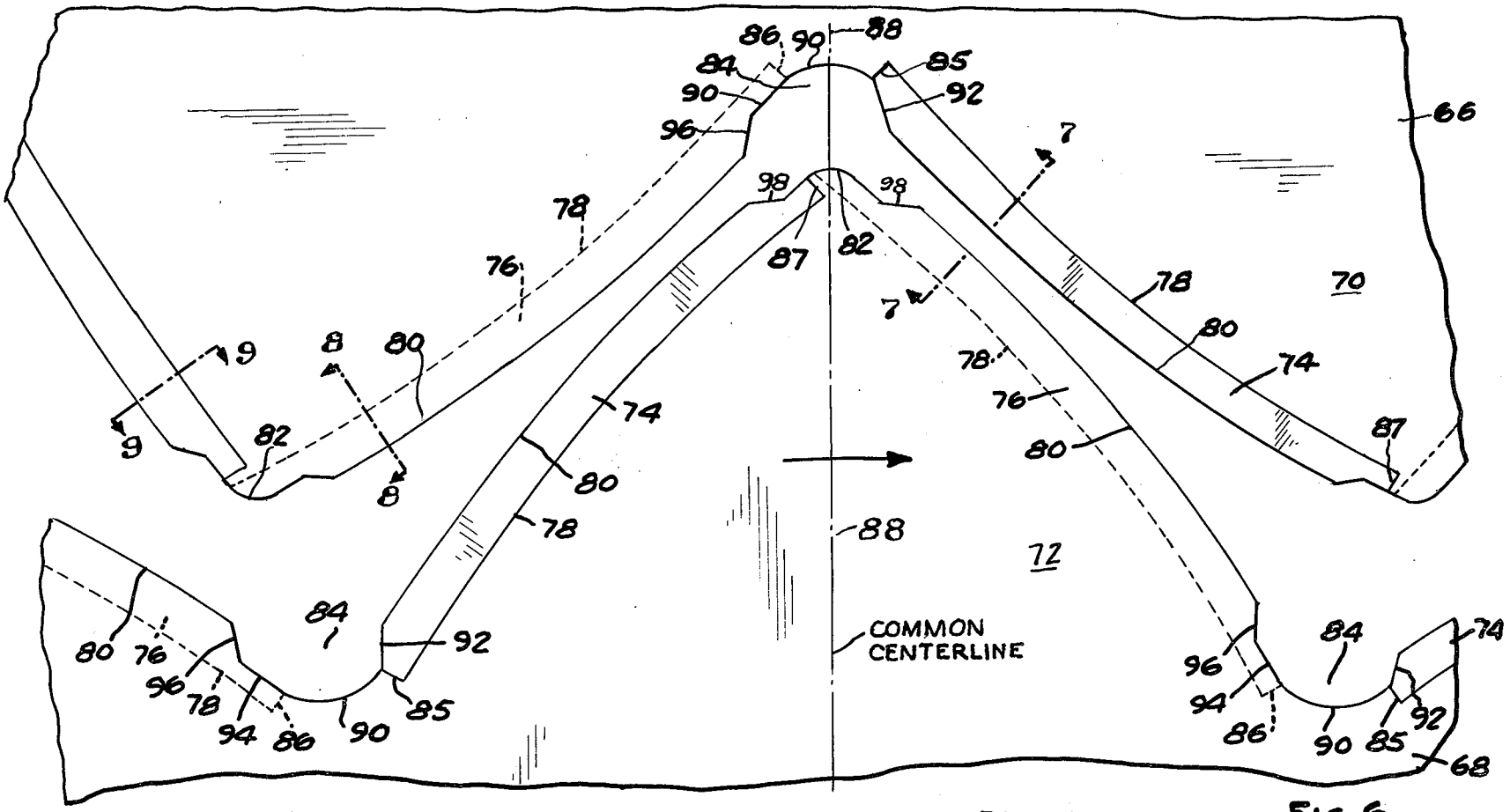
FIG. 6 is a view similar to FIG. 5 showing a pair of form rolls embodying the present invention.
Figure 7:
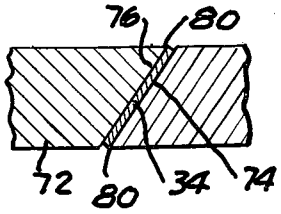
FIG. 7 is a sectional view along the line 7—7 in FIG. 6.
Figure 8:
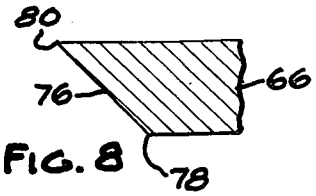
FIG. 8 is a sectional view along the line 8—8 in FIG. 6.
Figure 9:
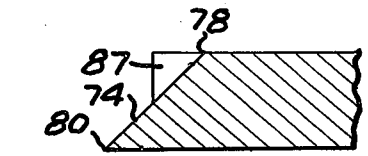
FIG. 9 is a sectional view along the line 9—9 in FIG. 6.

In FIG. 6 a section of fin rolls according to the present invention is shown. Each upper roll comprises a series of axially stacked discs 66 and each lower roll comprises a series of axially stacked discs 68. Each upper and lower disc is formed with a plurality of uniformly spaced teeth 70, 72 around its periphery. The teeth 70, 72 are provided with louver-forming involute side faces 74, 76. Faces 74, 76 are beveled as illustrated so that each has an inner edge 78 and an outer cutting edge 80. The beveled faces are all similarly inclined so that, when they roll into meshing engagement as shown in FIG. 7, these beveled faces are parallel and cut and form the louver 34. The crest of each tooth is defined by a rounded tip 82. The root space between successive teeth is defined by a crotch 84.

The beveled face 76 at the leading side of each tooth extends radially inwardly into the crotch area as at 86 and extends radially outwardly entirely across the tip 82. The beveled face 74 on the trailing side of each tooth terminates at its radially inner end within the crotch area as at 85 and at its radially outer end terminates as at 87 which is spaced radially inwardly of the inner edge 78 of the beveled face 76.

The tooth tips 82 are of symmetrical shape in plan relative to a radial line 88 extending through the crests of the teeth. On the other hand, as clearly shown in FIG. 6, the crotches 84 are of unsymmetrical shape. Each crotch comprises a rounded portion 90 at the vertex thereof. The rounded portion connects with the beveled face 74 by means of a straight radially inclined surface 92. The rounded portion 90 at the other side of each crotch is generally tangent to a radially outwardly inclined flat surface 94 which in turn connects with a more steeply inclined flat surface 96. The flat surface 92 is located substantially closer to the radial line 88 through the vertex of the rounded surface 90 than is the flat surface 96. In view of the inclination of faces 74, 76, the flat surfaces 92, 94, 96 are of progressively decreasing width in a direction toward the rounded surface 90 of the crotch. The symmetrically disposed flat surfaces 98 at each side of the tooth tip 82 are also of decreasing width in a direction outwardly from the tip because of the inclination of faces 74, 76. Although FIG. 6 illustrates the upper and lower discs spaced apart a substantial distance, it will be appreciated that in practice these discs are spaced apart a distance only sufficient to accommodate therebetween the thickness of the metal strip being formed.

Figure 10:
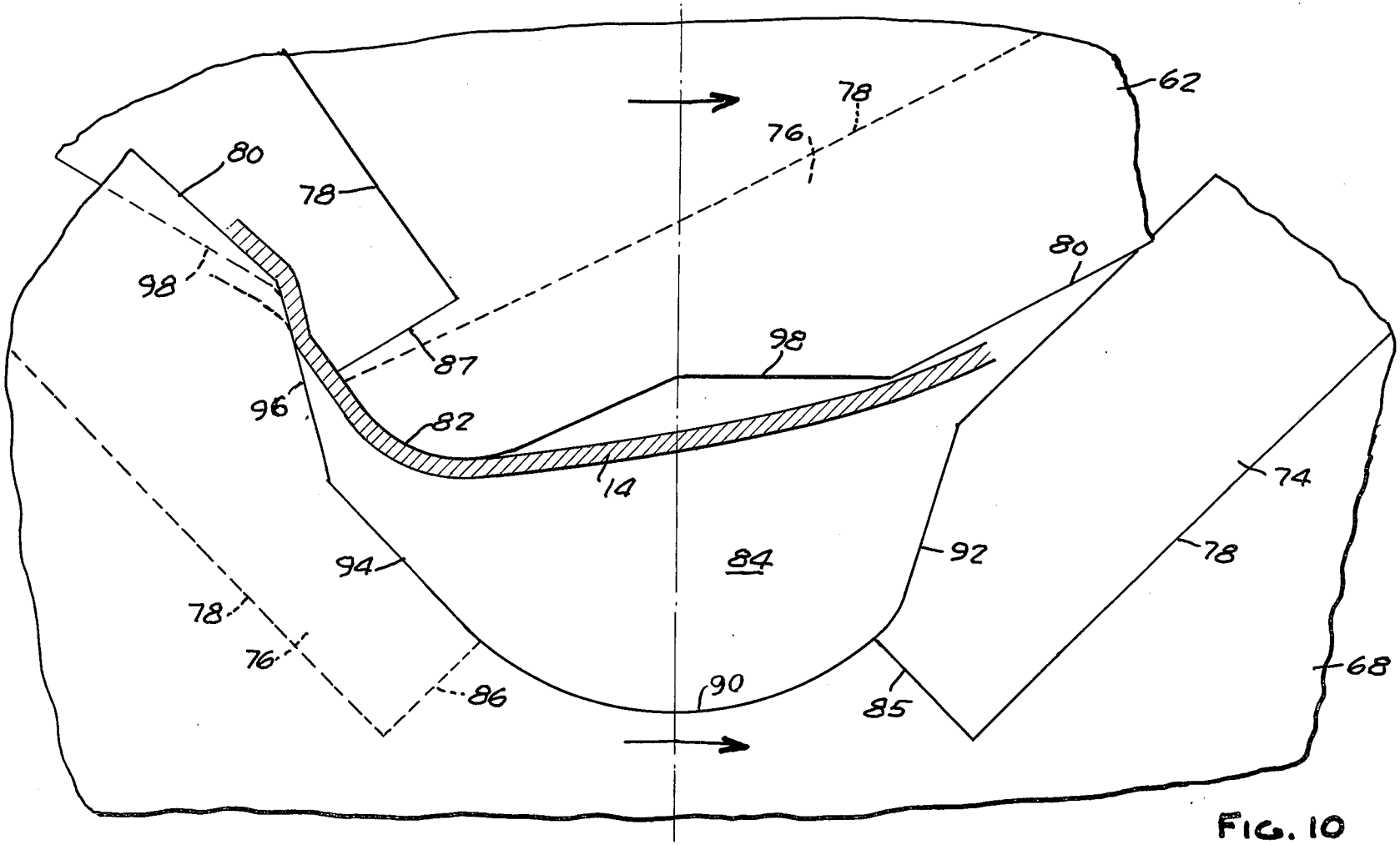

In FIGS. 10 thru 14 the upper and lower discs are shown as they progressively rotate in the direction illustrated by the arrows to form a pair of adjacent convolutions 30 connected by the return bend 32 and to cut and bend the louvers 34 therein. In the position of the discs illustrated in FIG. 10 the strip stock 14 is shown partially formed around the tip 82 of the upper disc 66 and cutting and forming of the louver at the left is initiated by the edge of flat surface 96 at the radially outer end thereof. On the right hand side of the crotch 84 of lower disc 68 the body of the louver is being cut and formed in a progressively radially inward direction relative to the lower disc. In FIG. 10 the upper and lower discs are shown in a position about 7° before bottom dead center position.

Figure 11:
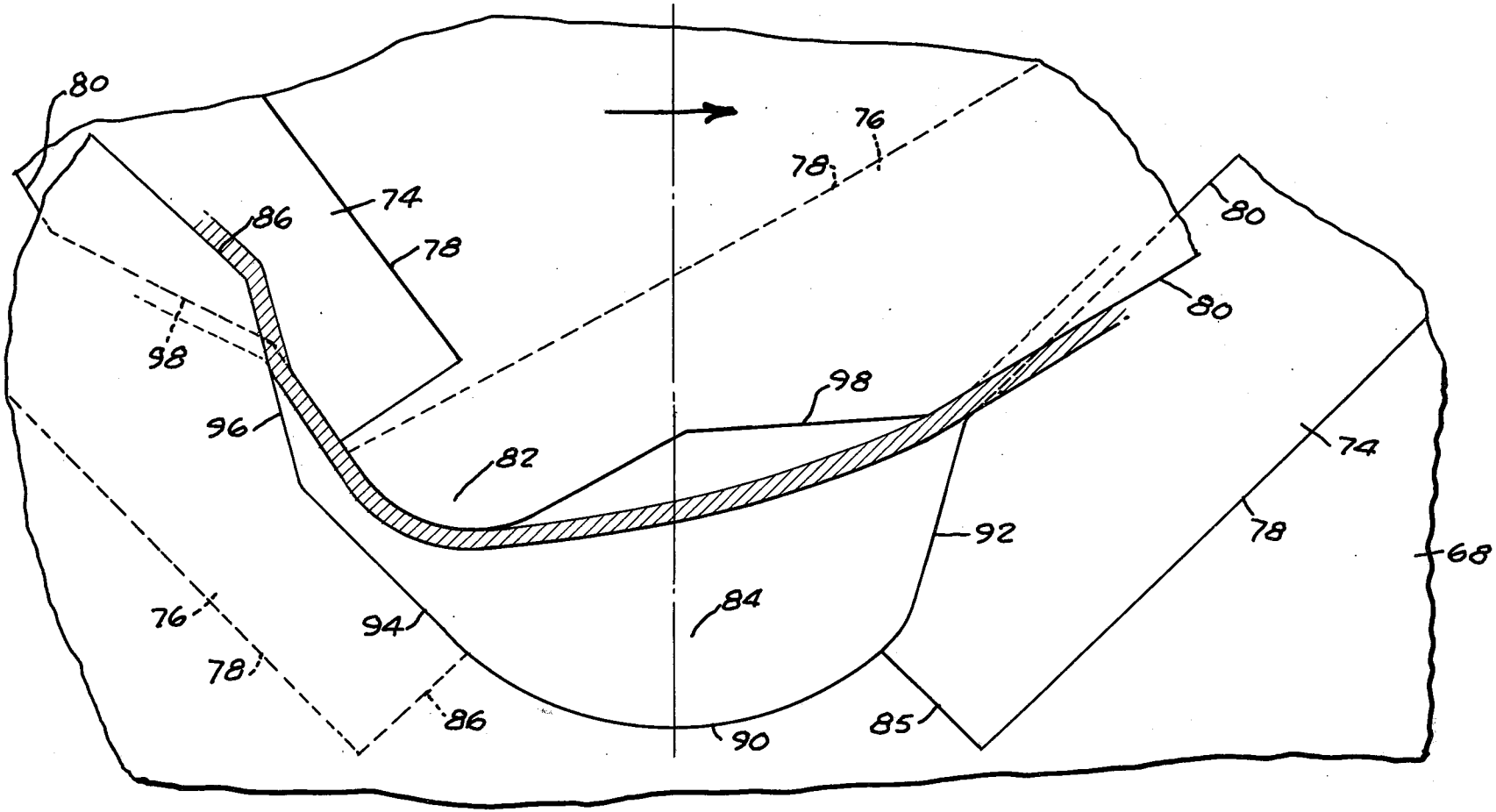
Figure 12:
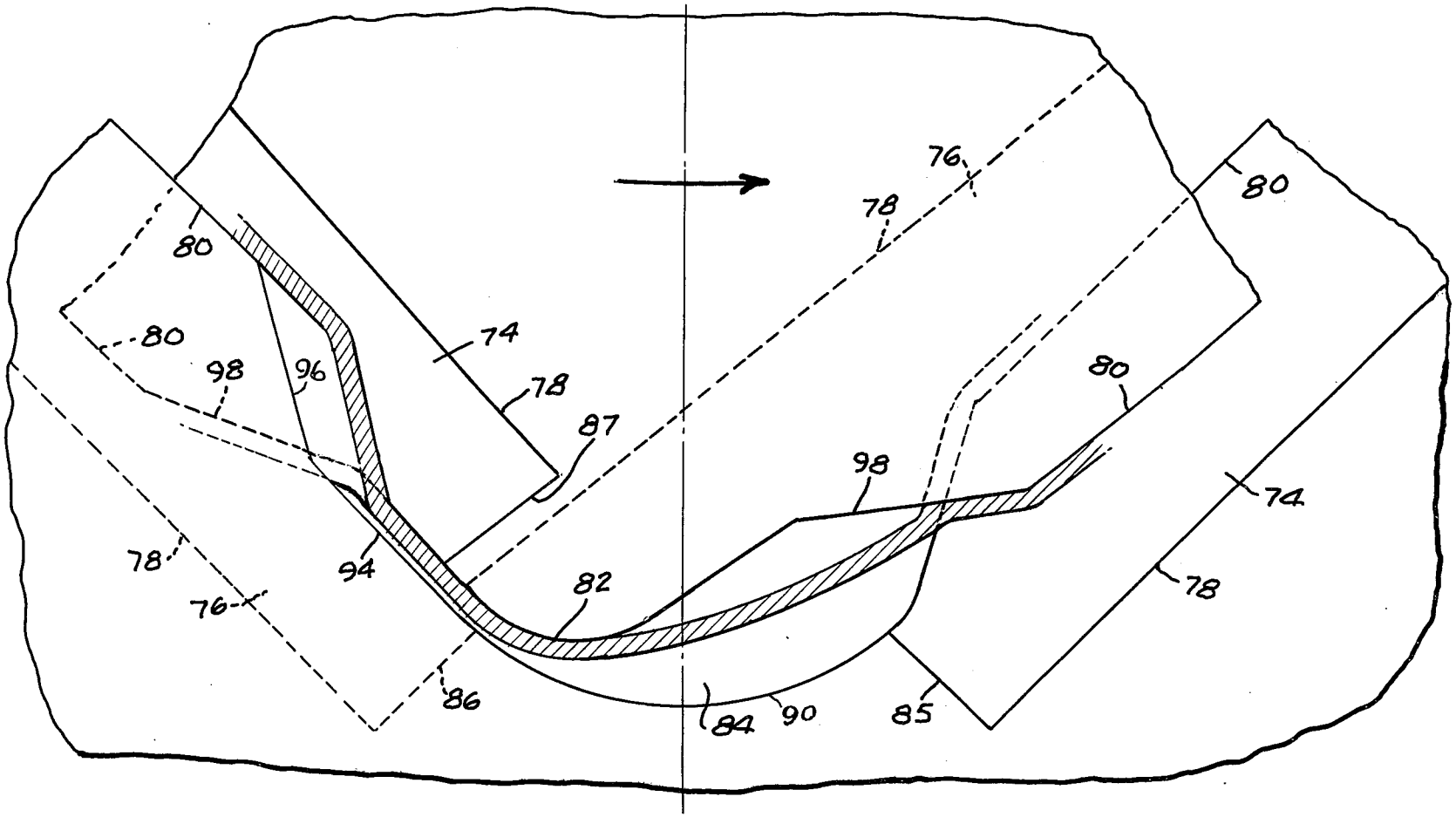
Figure 13:
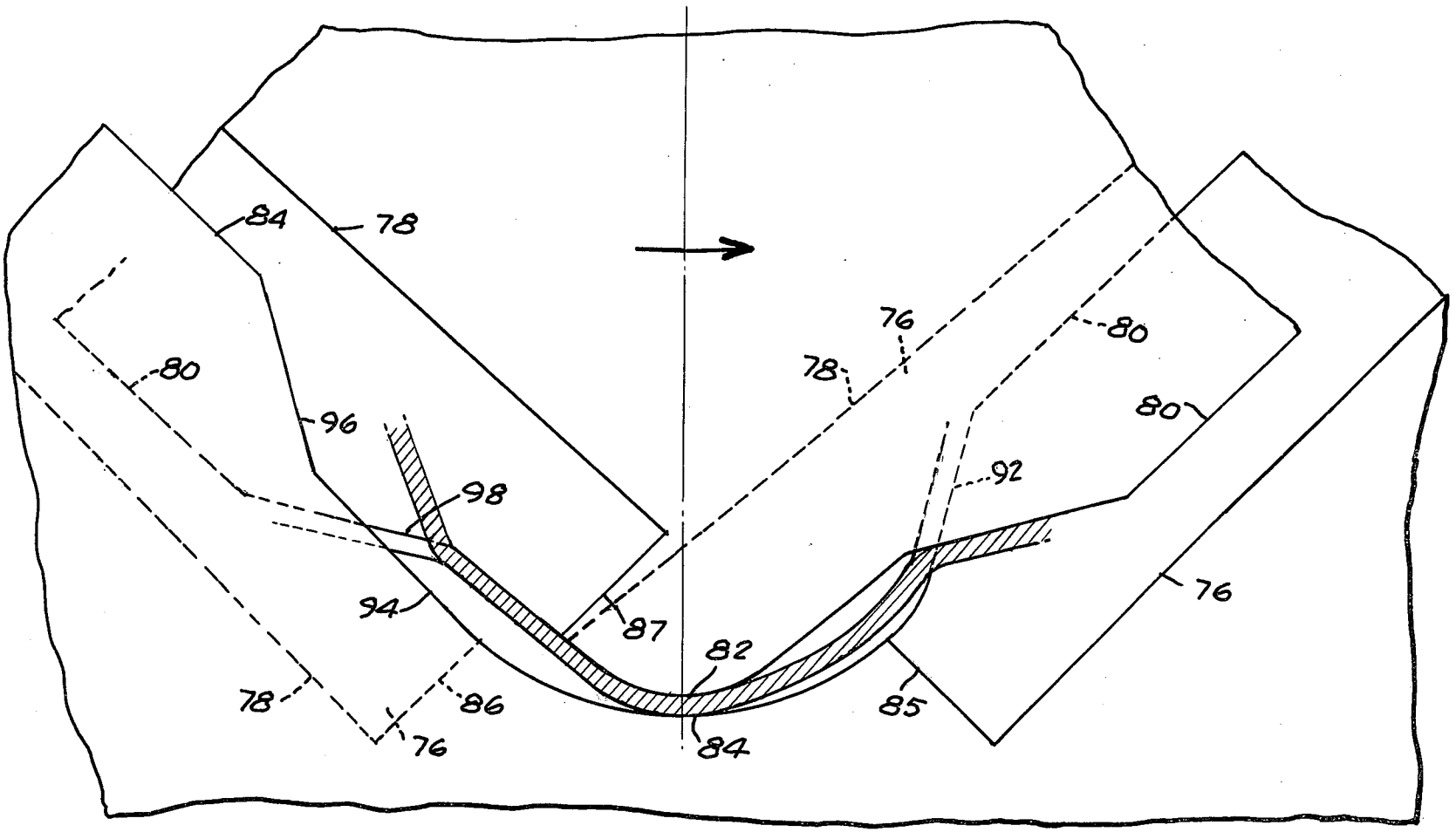
Figure 14:
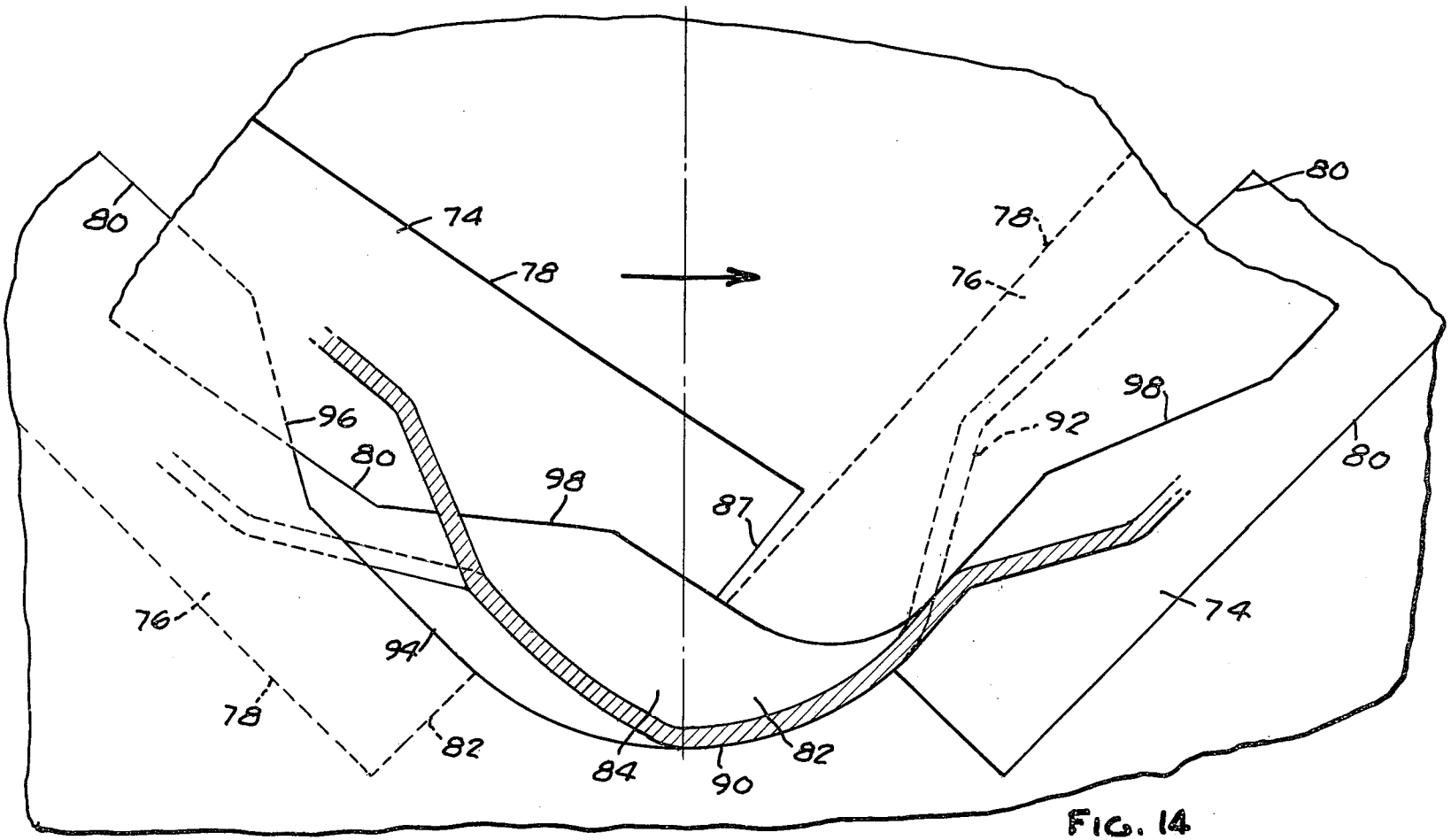

In FIG. 11 the upper and lower discs are shown at a position about 6° before bottom dead center position. When the discs advance to this position it will be noted that the left hand side of the louver vertex is being further formed and cut around the tip between the beveled faces 74, 76, the cutting action progressing radially inwardly relative to the lower disc 68 along the flat surface 96. At the same time, cutting and forming of the right hand side louver vertex is initiated. In this connection it will be observed that at the left hand side the stock is stretched around the tooth tip 82 and adheres to the left hand side of the tooth tip. As shown in FIG. 12, wherein the discs are illustrated in a position about 3° before bottom dead center, this cutting and forming action continues at both sides of the louver vertex being formed, the left hand side of the louver vertex being almost completely formed. In the position shown in FIG. 13, wherein the discs are at bottom dead center position, the left hand side of the louver vertex is completely formed while the formation and cutting of the louver at the right hand side continues to progress radially inwardly toward the crotch 84. Referring now to FIG. 14 wherein the discs are shown in a position about 4° beyond bottom dead center, it will be noted that continued rotation of the discs causes the left hand side of the louver vertex in its fully formed condition to be pulled away from the tip 82 of the upper disc and from the left hand side of crotch 84. The right hand side of the louver crest radius has now been coined by the tip 82 against the right hand side of the rounded surface 90 of the crotch 84. This maintains the stock adherred to the right hand side of the crotch 84 and displaces the partially formed return bend 32 to the right in crotch 84. At this point in the rotation of the discs the cutting and forming of the right hand side of the louver vertex nears completion.

It will be noted that, since the beveled leading face 76 is ground through the entire tooth tip profile of the upper roll, the tooth tip 82 itself can slide over the beveled face 74 on the trailing side of the tooth on the lower disc in the area of the flat surface 92 of the crotch. This allows the vertex of the louver to be cut deeper than would otherwise be possible and results in the completed fin structure wherein adjacent vertices of the louvers are spaced equally from the crest of the return bend connecting adjacent convolutions. At the same time this also permits a roll out of the tooth on the upper disc from within the crotch area on the lower disc and causes the return bend to be bodily displaced around the crotch to produce a symmetrically shaped return bend between the adjacent convolutions. Although the return bend is not truly semi-circular as the convoluted strip emerges from the form rolls, it is bent into a generally semi-circular shape when the strip is subsequently gathered.

I claim:

1. A pair of heat exchanger fin forming rolls, each comprising a plurality of gear-like discs having teeth spaced uniformly around the periphery thereof, said rolls being arranged on generally spaced parallel axes so that the teeth of the discs on one roll mesh with the teeth on the discs of the other roll when the rolls are rotated in one direction, each tooth terminating in a generally rounded tip at the radially outer end thereof and being connected with the adjacent teeth by a generally rounded crotch of greater curvature than the tip, each tooth having a leading face and a trailing face relative to said direction of rotation, said faces being beveled in a direction transversely of the plane of the disc so that each of said faces has circumferentially spaced inner and outer edges, said outer edges defining cutting edges on the opposite faces of the discs, said beveled faces of the teeth on the two sets of discs being in generally parallel overlapping relation when rotated into meshing relation, the leading face of each tooth being beveled from a point within the adjacent crotch in a direction radially outwardly through the tip of the tooth, the trailing face of each tooth being beveled from a point within the crotch to a point adjacent, but spaced radially inwardly from, the tip of the tooth, the radially inner end of the cutting edge of each trailing face terminating closer to the vertex of said crotch than the radially inner end of the cutting edge of each leading face.

2. Fin forming rolls as called for in claim 1 wherein each crotch is unsymmetrical about a radial line extending through the vertex thereof, one side of each crotch being inclined radially outward to the trailing face of the next successive tooth and the other side thereof being inclined radially outward to the leading face of the next preceding tooth, said one side of each crotch being inclined toward said radial line to a greater extent than the other side of said crotch.

3. Fin forming rolls as called for in claim 2 wherein the configuration and dimensions of each crotch are such that the beveled portion of the leading face of each tooth at the tip thereof overlaps the beveled face portion of said one side of the crotch with which it meshes when the discs are rotated in said direction.

4. Fin forming rolls as called for in claim 3 wherein the tip of each tooth is symmetrical about a radial line extending through the apex of each tooth.

5. Fin forming rolls as called for in claim 1 wherein the radially outer end portions of each crotch when viewed in plan comprise a pair of generally straight lines which converge in a radially inward direction.

6. Fin forming rolls as called for in claim 5 wherein said beveled faces extend to said straight lines.

7. Fin forming rolls as called for in claim 6 wherein the radially inner ends of said beveled faces extend radially inwardly past said straight lines.

8. Fin forming rolls as called for in claim 7 wherein said straight line on the leading side of the crotch is disposed closer to a radial line through the vertex of the crotch than the straight line on the trailing side of the crotch.

9. Fin forming rolls as called for in claim 8 wherein said straight lines define generally flat faces of progressively decreasing width in a direction radially inwardly.

10. Fin forming rolls as called for in claim 9 wherein the discs are dimensioned such that the leading side of the tooth tip on one disc overlaps the beveled face on the trailing side of the disc meshed therewith in the area of the flat face of diminishing width on the leading side of the crotch when the discs are rotated.

* * * * *